US005551819A

United States Patent [19]

Stern

[11] Patent Number: 5,551,819

[45] Date of Patent: Sep. 3, 1996

[54] END PLATE FOR RAILWAY CROSSTIES, SCAFFOLDING PLANKS, AND OTHER WOOD PRODUCTS AND METHODS OF USE

[76] Inventor: E. George Stern, VA Polytechnic Institute and State University, Dept. of Wood Science & Forestry Products, Blacksburg, Va. 24060

[21] Appl. No.: 366,306

[22] Filed: Dec. 29, 1994

[51] Int. Cl.[6] ..... F16B 15/00; E04B 1/00

[52] U.S. Cl. ..... 411/466; 411/461; 411/912; 411/921; 52/745.19

[58] Field of Search ..... 441/461, 462, 441/463, 464, 465, 466, 467, 468, 457, 912, 921; 52/745.19

[56] References Cited

U.S. PATENT DOCUMENTS

| | | | |
|---|---|---|---|
| 2,273,507 | 2/1942 | Beegle | 411/912 X |
| 3,211,043 | 10/1965 | Sanford | 411/465 |
| 3,377,905 | 4/1968 | McAlpine | 411/468 |
| 3,892,160 | 7/1975 | Jureit et al. | 411/468 |
| 5,116,179 | 5/1992 | Matlock . | |
| 5,234,279 | 8/1993 | Poutanen . | |

FOREIGN PATENT DOCUMENTS

| | | | |
|---|---|---|---|
| 2268183 | 11/1975 | France | 411/466 |

OTHER PUBLICATIONS

Stern, George E., "35 years of experience with certain types of connectors used for the assembly of wood structures and their components,", Forest Products Journal, vol. 42 No. 11/12 pp. 33–45.

*Primary Examiner*—Neill R. Wilson
*Attorney, Agent, or Firm*—Larson and Taylor

[57] ABSTRACT

A metal end plate for a wood product including a plurality of elongated teeth protruding substantially transversely from the intermediate portion of the plate and a plurality of elongated teeth protruding substantially transversely from at least two opposed edges of the plate. These edge teeth are located such that, when the teeth are pressed into the end of a wood product, they engage the wood fibers near the outer perimeter of the end of wood product to provide restraining force at the perimeter of the end of the wood product to prevent large splits or cracks from forming or reappearing. In a preferred embodiment, the edge teeth engage the wood fibers within about ½ inch of the edge of the end of the wood product. Also, in a preferred embodiment the length of the edge teeth is on the order of 17/32 inch for average density wood and longer for wood of low density.

7 Claims, 2 Drawing Sheets

END PLATE FOR RAILWAY CROSSTIES, SCAFFOLDING PLANKS, AND OTHER WOOD PRODUCTS AND METHODS OF USE

BACKGROUND OF THE INVENTION

1. Field of the Invention

The present invention relates to formed metal end plates for end-plating railway crossties, scaffolding planks, and other wood products, and methods of using the end plates.

2. The Prior Art

Wood products such as railway crossties are cut from green wood and, as such wood products season or cure, they frequently develop large cracks or splits at their ends as a result of the relatively large differential between end-grain and side-grain moisture movement. Wood products may be treated to retard deterioration; but the treatment only penetrates the wood products to a limited depth. Thus, the deep interiors of the wood products remain untreated. As large cracks and splits enlarge, they reach into the untreated portions of the wood products, allowing these untreated portions to be exposed to the elements. This causes deterioration deep in the wood products. In the case of railway crossties, this interior damage may result in weakened crossties and rail dislocation, thereby requiring repair or even replacement.

Early in the development of this art, S-shaped and C-shaped irons (described in more detail below in connection with FIGS. 2 and 3) were used to prevent or retard cracks and splits in wood products, especially railway crossties. These devices suffered from the disadvantage that they could only reinforce the wood products to a limited extent as a result of their shape and location in the wood product end.

In addition to the irons mentioned above, end plates have been provided for preventing or reducing cracking or splitting of wood products. U.S. Pat. No. 5,116,179 (Matlock) discloses an end plate having teeth or prongs punched from the intermediate portion of the plate. These teeth are bent to an angle slightly less than 90 degrees and are pressed into the end of a wood product, thereby retarding large cracks and splits from forming in the wood product. The angle of the teeth helps prevent inadvertent withdrawal of the end plate teeth from the wood product. As with most prior art end plates, the plate of the Matlock patent is made from a thin steel plate, which is galvanized to reduce rusting.

Almost all of the prior art end plates provide prongs or teeth punched from the intermediate portion of the plates. While these teeth grip the interior end grain of the wood product, they do not effectively grip the wood fibers near the edges or perimeter of the end of the wood product. Therefore, large cracks and splits are allowed to develop near these edges. The cracking and splitting forces are greater at the edges of the wood product than at the interior of the wood product. Generally, these forces increase with increased distance from the cross-sectional center of the crosstie. Further, the edges of the prior art end plates are exposed, causing safety concerns.

SUMMARY OF THE INVENTION

In common with the end plates in the prior art, the end plate of the present invention is made from a flat metal plate which is punched or sheared from a metal coil. The teeth or prongs are punched from the flat metal plate and are bent substantially transversely to the flat plate such that they can be pressed into the end of a railway crosstie or other wood product prior to the seasoning of the wood product, or after side pressure has been applied at the end of the wood product to completely or partially close any cracks and splits which have previously developed.

A key feature of the present invention involves the incorporation of single or multiple rows of teeth along opposite plate edges in addition to the normal intermediate teeth. These edge teeth are located such that, when they are pressed into the end of the wood product, they protrude into the end grain of the wood product near the outer edge. Thus, large cracks and splits are prevented from forming, or re-appearing, at the outer edge of the wood product end. Instead of these large cracks and splits, numerous small cracks are formed between the various intermediate teeth and between the intermediate teeth and the edge teeth. No damage is caused to the wood product by these small cracks, since they do not penetrate beyond the treated portion along the surface of the wood product.

Each individual wood product has a specific grain pattern and particular growth characteristics, such as the location of the pith and the angle of the annular growth rings with respect to the edges of the wood product. Depending on these characteristics, and the ensuing cracking and splitting forces in the wood product, an end plate for a wood product with a square or rectangular cross section may provide edge teeth along two opposite edges or, if desirable, along all edges. Optimum performance is provided by plates with edge teeth along all four edges of a wood product with a square or rectangular cross section. Other multi-sided plates, using the same technology, are possible for wood products with alternatively shaped cross sections. To provide optimum performance, the edge teeth should be located as closely as possible to the edges of the wood product without damaging the surface of the wood product, preferably within ½ inch (12 mm) of the edge.

The spacing between the end plate teeth should be relatively small to distribute the retaining force to more evenly counteract the interior wood splitting forces, thereby ensuring that small surface cracks form in the end of the wood product instead of large deep cracks and splits. However, spacing between the end plate teeth must be kept sufficiently large to provide for adequate material between the punched teeth, in order to retain the structural integrity of the end plate. Also, if the spacing between the teeth is too small, the end grain fibers of the wood product will be weakened by excessive wood fiber separation.

Since the end plate teeth are pressed into the end grain of the wood product, the teeth need to be sufficiently long to provide satisfactory resistance to withdrawal from the end grain, as the wood product shrinks and swells under adverse environmental conditions. The edge teeth should be at least ½ inch (12 mm) long for wood of average density and longer teeth, up to 1 inch (25 mm), should be used if the end plate is applied to wood of low density. Optimally, for wood of average density, the edge teeth should be about 17/32 inch (13.5 mm) long. These long teeth perform in a superior manner to short teeth, prongs, barbs, and plugs. Also, the edge teeth should be wider than the intermediate teeth, since they are meant to counteract forces which are greater at the perimeter of the end of the wood product than at its intermediate portion.

The edge teeth on each end plate may be offset on opposing edges (non-symmetrical) and configured such that, during manufacture, one end plate may be punched from a metal coil so that its edge teeth nest with the edge teeth of an adjacent plate. Thus, less scrap metal would be produced than if symmetrical end plates having edge teeth were punched from the metal coil, since the teeth of a symmetrical end plate would not nest with those of adjacent plates.

Accordingly, it is an object of the present invention to provide an end plate for a wood product that effectively engages the intermediate portion as well as the outer edges of the end of the wood product to minimize cracking or splitting of the wood product.

It is a further object of the present invention to provide an end plate for a wood product that provides closer spacing between the teeth along the edge or perimeter of the end plate than the spacing between the teeth in the intermediate portion of the end plate, so as to distribute retention forces to more evenly counteract the interior forces of the wood product along the edge of the wood product while still maintaining the structural integrity of the end plate.

Other objects, features, and advantages of the present invention will be set forth in, or will become apparent from, the detailed description of the preferred embodiments of the invention which follows.

DESCRIPTION OF THE PREFERRED EMBODIMENTS

Figure 1:
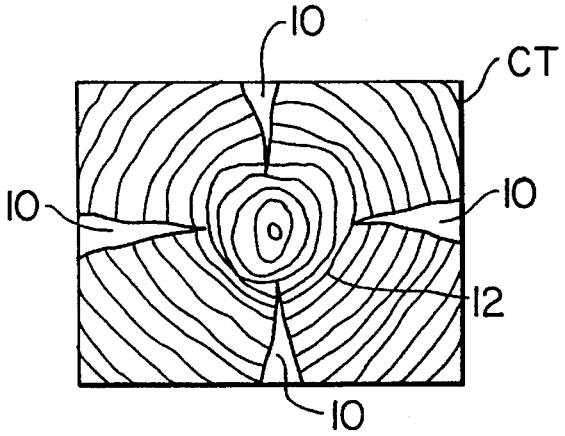
FIG. 1 PRIOR ART
FIG. 1 is an end view of an unreinforced railway crosstie that has already seasoned and cracked.

FIG. 1 shows an end view of a railway crosstie CT that has already seasoned or cured. Cracks 10 have developed in the railway crosstie CT and these cracks will allow the interior untreated portion 12 of the railway crosstie to be exposed to the elements.

Figure 2:
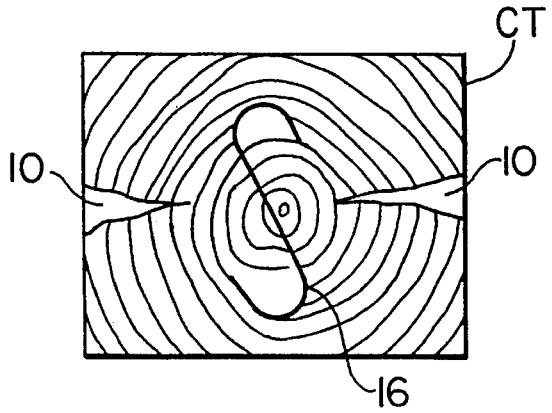
FIG. 2 PRIOR ART
FIG. 2 is an end view of a railway crosstie reinforced by an S-iron of the prior art.

FIG. 2 shows an end view of a railway crosstie CT that has been reinforced with an S-iron 16 of the prior art. The S-iron 16 is designed to bind the end fibers of the wood product together to prevent cracking or splitting in two of the areas, viz. the upper and lower areas, of the railway crosstie CT in which cracks 10 appeared in FIG. 1. The drawback to the S-iron 16 is that it only reduces or prevents cracking over a limited area so that the internal forces in the railway crosstie will simply cause cracking to occur elsewhere.

Figure 3:
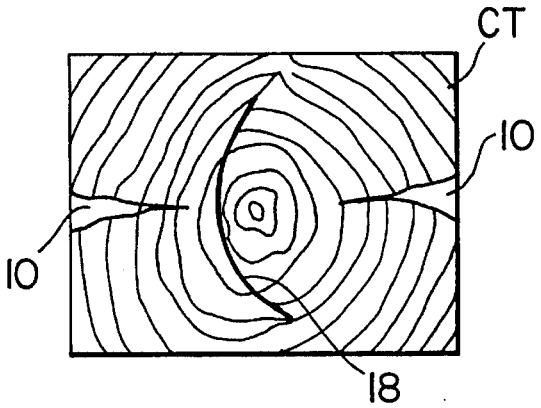
FIG. 3 PRIOR ART
FIG. 3 is an end view of a railway crosstie reinforced by a C-iron of the prior art.

FIG. 3 shows an end view of a railway crosstie CT that has been reinforced with a C-iron 18. The C-iron 18 works similarly to the S-iron of FIG. 2 and has the same drawback.

Figure 4:
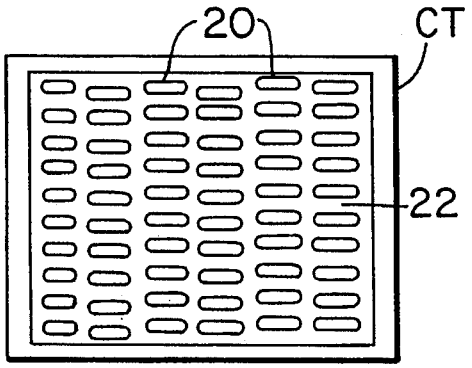
FIG. 4 PRIOR ART
FIG. 4 is an end view of a railway crosstie reinforced by a conventional end plate of the prior art.

FIG. 4 shows an end view of a railway crosstie CT that has been reinforced with a conventional type end plate 22. The end plate in this figure is similar to that of the Matlock patent, U.S. Pat. No. 5,116,179, discussed above. End plate 22 has only intermediate teeth 20. While the intermediate teeth 20 do an adequate job of reinforcing the railway crosstie at the interior of the cross-section, thereby retarding the formation of large cracks and splits, intermediate teeth 20 do not provide adequate reinforcement at the edges of the crosstie where the forces are greatest. Therefore, cracks and splits can develop along the edges and, over time, such cracks and splits enlarge because they are not constrained.

Figure 5:
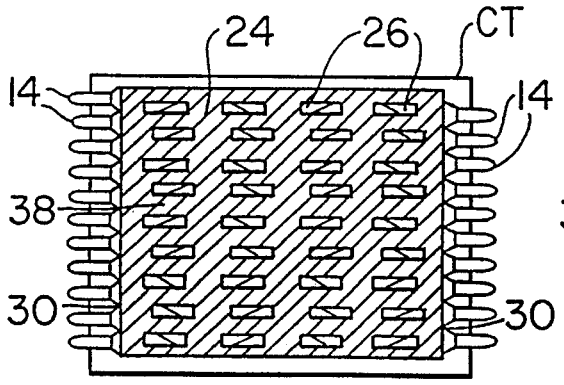
FIG. 5 is an end view of a railway crosstie overlaid by an end plate constructed in accordance with a first embodiment of the present invention, having edge teeth only along the two end edges of the plate.

FIG. 5 shows an end view of a railway crosstie CT which is overlaid by an end plate of the present invention 24. The end plate 24 is made from a flat metal plate and has edge teeth 14 only along its end edges 30. The end plate 24 is shown with the edge teeth 14 and the intermediate teeth 26 not yet bent with respect to the surface 38 of the end plate, to penetrate into the end of the wood product. Intermediate teeth 26 are shown to be triangular in shape, with two nesting teeth made from each small rectangular area; however, this particular shape is not critical to the present invention. In practice, teeth 14 and 26 would be bent to an angle slightly less than 90 degrees (about 88 degrees) with respect to the surface of end plate 24, or about 2 degrees with respect to a line perpendicular to end plate 24, as shown by the angle described at 34 in FIG. 6. In practice, teeth 14 and 26 would be bent during manufacture, prior to being pressed into the end of the railway crosstie CT. This angle of the teeth permits the wood fibers to spread the teeth in alternate directions as they are pressed into the end of the crosstie, thus decreasing any tendency of the teeth of the end plate to withdraw from the crosstie.

Spacing between adjacent edge teeth is small in relation to the spacing between adjacent intermediate teeth and the spacing between the intermediate teeth and the edge teeth. Structural integrity of the plate is a concern at the intermediate portion of the plate and it is not as much of a factor along the edges of the plate. However, spacing between adjacent edge teeth should be large enough to avoid excessive separation of the fibers of the wood product.

Figure 6:
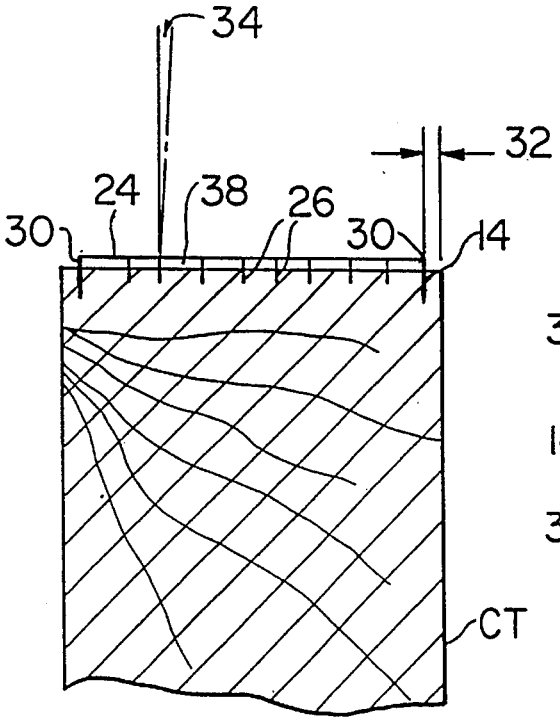
FIG. 6 is a cross-sectional view of the railway crosstie of FIG. 5 with the end plate of FIG. 5 embedded therein.

FIG. 6 shows a cross-sectional view of the end of railway crosstie CT shown in FIG. 5, with an end plate of the present invention 24 pressed in place. The end plate 24 has edge teeth only along the end edges 30 of the plate, as in FIG. 5. However, in this figure, the edge teeth 14 and the intermediate teeth 26 are shown bent with respect to the surface 38 of the end plate and pressed into the crosstie end. The edge teeth 14 are 17/32 inch (13.5 mm) long, but may be longer for woods of low density. The length of the intermediate teeth 26 in this embodiment is shorter than the length of the edge teeth 14; but in other embodiments the intermediate teeth may be equal to, longer, or shorter than the edge teeth, as required for the particular application. Also, the distance 32 between edge teeth 14 and the outer edge of the railway crosstie CT is preferably less than about ½ inch (12 mm), to provide the most effective reinforcement along the edge of the crosstie. However, the edge teeth should not be so close to the edge of the crosstie that they cause the wood fibers to separate at the edge of the crosstie or cause the teeth to surface along the crosstie side.

The spaces between adjacent intermediate teeth and the spaces between the intermediate teeth and the edge teeth should be small enough to prevent large cracks and splits; yet large enough to retain sufficient plate material to preserve the structural integrity of the plate. As in FIG. 5, the spacing between adjacent edge teeth can be smaller than either of the above spacings.

Figure 7:
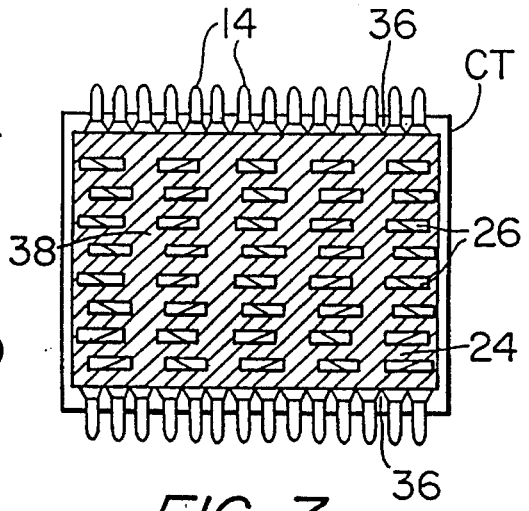
FIG. 7 is an end view of a railway crosstie overlaid by a further embodiment of the end plate of the present invention having edge teeth only along the two side edges of the plate.

FIG. 7 shows an end view of a railway crosstie CT which is overlaid by another embodiment of an end plate of the present invention 24. This figure is similar to FIG. 5 except that the end plate 24 in this figure has edge teeth 14 only along its side edges 36.

Figure 8:
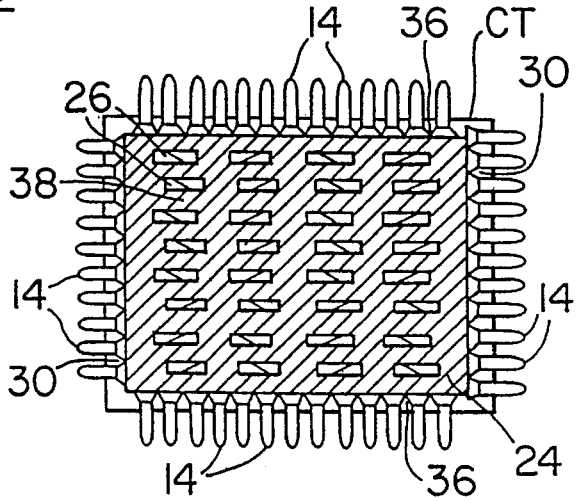
FIG. 8 is an end view of a railway crosstie overlaid by yet another embodiment of the end plate of the present invention having edge teeth along the two end edges and the two side edges of the plate.

FIG. 8 shows an end view of a railway crosstie CT which is overlaid by another embodiment of an end plate of the present invention 24. This figure is similar to FIGS. 5 and 7 except that the end plate 24 in this figure has edge teeth 14 along its end edges as well as its side edges.

Although the invention has been described in detail with respect to preferred embodiments thereof, it will be apparent to those skilled in the art that variations and modifications can be effected in these embodiments without departing from the spirit and scope of the invention.

I claim:

1. An end plate for a wood product, said wood product having an end surface defined by a peripheral edge, said end plate comprising:

a metal plate of substantially rectangular shape and including two surfaces, an intermediate portion, first and second substantially opposed edges and third and fourth substantially opposed edges;

a plurality of elongated intermediate teeth, extending outwardly from said intermediate portion from one surface of said metal plate, for engaging said end surface of said wood product; and a plurality of elongated edge teeth, located along said first and second substantially opposed edges and along said third and fourth substantially opposed edges and extending outwardly from said one surface of said metal plate, for engaging said end surface of said wood product near said peripheral edge thereof.

2. An end plate for a wood product as in claim 1 wherein said edge teeth are approximately 17/32 inch in length.

3. An end plate for a wood product as in claim 1 wherein said edge teeth are between approximately 17/32 inch and 1 inch in length.

4. An end plate for a wood product as in claim 1 wherein said edge teeth are located within ½ inch of said peripheral edge of said wood product when said edge teeth are engaged in said wood product.

5. An end plate for a wood product as in claim 1 wherein the spacing between adjacent ones of said edge teeth is smaller than the spacing between adjacent ones of said intermediate teeth and smaller than the spacing between adjacent said intermediate teeth and said edge teeth.

6. An end plate for a wood product as in claim 1 wherein said metal plate is substantially flat.

7. A method for end plating a wood product having a substantially flat end surface having an area defined by a peripheral edge and including at least first and second opposed sides, comprising the steps of:

providing an end plate comprising a metal plate having two opposed surfaces of an area that is substantially the same as but smaller than said area of said end surface, an intermediate portion, and at least first and second substantially opposed edges, a plurality of elongated intermediate teeth extending outwardly from said intermediate portion on one surface of said metal plate, and a plurality of elongated edge teeth located along said first and second substantially opposed edges and extending outwardly from said one surface of said metal plate;

exerting compressive force on said first and second opposed sides of said wood product; and pressing said end plate into said end of said wood product such that said edge teeth and said intermediate teeth engage the wood fibers of said end of said wood product.

* * * * *